United States Patent [19]

Wall

[11] Patent Number: 4,944,059

[45] Date of Patent: Jul. 31, 1990

[54] PRENATAL BODY SUPPORT

[75] Inventor: Carole Wall, Lake Arrowhead, Calif.

[73] Assignee: Abby Brooks Corporation, Lake Arrowhead, Calif.

[21] Appl. No.: 413,999

[22] Filed: Sep. 27, 1989

[51] Int. Cl.[5] ..... A47C 27/00; A47C 27/08

[52] U.S. Cl. ..... 5/431; 5/449

[58] Field of Search ..... 5/431, 449, 450, 451, 5/441, 462, 464, 481

[56] References Cited

U.S. PATENT DOCUMENTS

| | | | |
|---|---|---|---|
| 3,287,747 | 11/1966 | Ellsworth | 5/431 |
| 3,988,793 | 11/1976 | Abitbol | 5/462 |
| 4,054,960 | 10/1977 | Pettit et al. | 5/462 |
| 4,397,052 | 8/1983 | Lund, III | 5/431 |
| 4,754,510 | 7/1988 | King | 5/431 |
| 4,819,287 | 4/1989 | Halverson | 5/431 |

OTHER PUBLICATIONS

J & L Demensions, Inc. {Undated Leaflet}.
ReCreations Maternity Wardrobe Catalogue {current-/undated}; Item D-Order Form.
Materna Mate: Advertisement Faxed to applicant by T. J's Kiddies Korner, 07/24/1989.
Prenatal Pillo; Advertisement from Item 2 Catalogue.

*Primary Examiner*—Alexander Grosz
*Attorney, Agent, or Firm*—Georges A. Maxwell

[57] ABSTRACT

A prenatal body support upon which a pregnant woman lies, face down, and that functions to remove the weight and pressure of a fetus within her abdomen from within her pelvic cavity and adjacent her spine and that relieves stresses imposed on her pelvis and spine caused by the weight and size of the fetus. The support comprises a soft, compressible and resilient body with front and rear ends, laterally spaced sides, a bottom surface and a top body supporting surface. The top body supporting surface has a high rear pelvis support portion extending longitudinal and transverse the rear end portion of the body, a pair of laterally spaced abdomen support portions extending longitudinally forward from the pelvic support portion, a longitudinally and transversely extending downwardly and forwardly inclined chest support portion forward of the abdomen support portions, a low forward longitudinally and transversely extending head support portion at the front end of the body and a central abdomen receiving recess opening upwardly between the abdomen support portions and between the pelvic and chest support portions of the top surface.

15 Claims, 3 Drawing Sheets

PRENATAL BODY SUPPORT

BACKGROUND OF THE INVENTION

In the course of childbearing, women must endure considerable discomfort and frequently suffer serious physical impairments throughout their pregnancies.

As a fetus develops in a women's womb, it continuously grows in size and weight. As the fetus grows, it displaces certain of the organs that occur within the woman's abdomen, stretches or distends certain muscles and tissues, compresses other muscles and tissues and presents notable added weight that the woman must carry and that materially adversely affects the woman's posture and balance.

The most common and most difficult to correct difficulties experienced by a woman during pregnancy is lower back pain caused by the ever increasing size and weight of the fetus she carries. As the fetus grows, it moves to project forwardly within the woman's abdomen causing an imbalance that the woman must compensate for as by throwing her upper torso back and her lower torso and pelvis forward. Such an adjustment of the woman's posture results in adverse distortion or backward bowing of her spine and in notable changes in the distribution of weight and forces throughout the whole of her body, particularly in and about the pelvic region and lower lumbar region of her back. In addition to the above, the presence of the growing fetus in a woman's abdomen often exerts weight and pressures within the woman's abdomen that interfere with or obstruct the normal operation and function of her body parts. For example, it is not infrequent that the presence of a fetus will exert pressures on nerves, causing pain or discomfort; press on veins and arteries, causing adverse losses of circulation; and, pressure on other organs that results in impaired functioning thereof.

For many years, the most common advice and treatment for a woman who is suffering those adverse effects of childbearing that are briefly noted above has been to "stay off your feet as much as possible" or "bed rest." Both of these directives are intended to unstress and rest the lower back and/or to redirect the bulk and weight of the fetus from down within the woman's pelvic cavity, where it is normally directed when the woman sits or stands upright.

In the recent past, it has been determined that if a pregnant woman bends over and stands on her elbows and knees, with her head down, the weight of and pressures exerted by the fetus she carries are shifted from within her pelvic cavity, relieving the adverse effects otherwise caused thereby. It has been further determined that if this position is assumed for appropriate periods of time the adverse effects otherwise caused by the weight and pressures of the fetus can be notably reduced or eliminated.

It has also been determined that when assuming the above position, if a woman bends her head down and arches her back upwardly those pains and/or the discomfort at or about her lower back can be further notably relieved. The great shortcoming with the above noted "exercise" resides in the fact that it requires the expending of considerable work energy and cannot be continued for a sufficient period of time to attain any long lasting effect.

The prior art provides various wedge-shaped cushions and the like that are intended to be strategically placed in supporting engagement with and about the pregnant woman's body to lift and/or support her body in such a manner as to relieve those discomforts and/or pains that are often experienced during pregnancy. Such special pillows and/or supports have proven to be no more effective than are common pillows shoved and/or stuffed about a pregnant woman's body in a desired and comforting manner.

Yet other efforts to relieve the discomforts and pains associated with pregnancy has been to cut or otherwise form "tummy" or "belly" openings in mattresses and other horizontal body supports on which pregnant women can lie, face down, with their fetus distended lower abdomens or "bellies" depending freely into the openings. While the provision of body supports with belly openings work to relieve the weight and pressure of fetuses within the pelvic cavities of women who use them, they work to, in effect, induce the women's bodies to drop down into and through the openings, causing further backward bending of the women's backs and exacerbating those pains and discomfort that the women experience as a result of the adverse distortion and bending of their backs caused by their pregnancies.

OBJECTIVES AND FEATURES OF THE INVENTION

It is an object of my invention to provide a novel body support for pregnant women that effectively, effortlessly arches the lower lumbar region of a user's back and spine forwardly to relieve that discomfort which is caused by pregnancy induced rearward bending of the user's back and to thereby afford the user's back effective relief and healing rest.

It is another object of my invention to provide a novel body support of the general character referred to above that effectively and effortlessly causes the fetus (and womb) of the user to move upwardly from within the woman's pelvic cavity and forwardly away from her spine to relieve the weight and pressure otherwise directed within her pelvic cavity and upon her spine and away from those organs and body parts that are or might otherwise be adversely effected by the weight of and forces exerted by the fetus.

Another object of my invention is to provide a novel body support of the general character referred to above that is such that its user's body is effectively and effortlessly disposed in a position that closely simulates that knee and elbow standing position, with arched back, that is known to be that position that most commonly and effectively relieves those pains and discomforts most commonly associated with pregnancies.

It is an object and feature of my invention to provide a cushion-like body support for pregnant women with front and rear end and opposite sides and that is characterized by an elevated or high pelvic supporting rear end portion, a low head and shoulder supporting front end portion, a central upwardly opening abdomen receiving recess and a pair of laterally space anterior abdominal support portions at opposite sides of the recess.

Yet another object and feature of my invention is to provide a body support of the general character referred to in the foregoing that is such that when used it serves to induce the fetus to move and to assume proper and desired position within its related womb during each stage of its development and that is such that when used, the spine of the woman using it is appropriately disposed for a physician to effect lumbar puncture for anesthesia or diagnostic purposes.

Finally, it is an object and feature of my invention to provide a body support of the general character referred to above that can be made in the form of sculptured and/or laminated unit of soft resilient foam plastic; can be an inflatable (air or water filled) structure comprising an exterior casing fabricated of flexible sheet plastic; or, can be made in the form of a fabric or sheet plastic "bean-bag" structure filled with a fluid mass of particulate material, as desired or as circumstances require.

The foregoing and other objects and features of my invention will be made fully understood in the following detailed description of my invention throughout which description reference is made to the accompanying drawings.

DETAILED DESCRIPTION OF THE INVENTION

Figure 1:
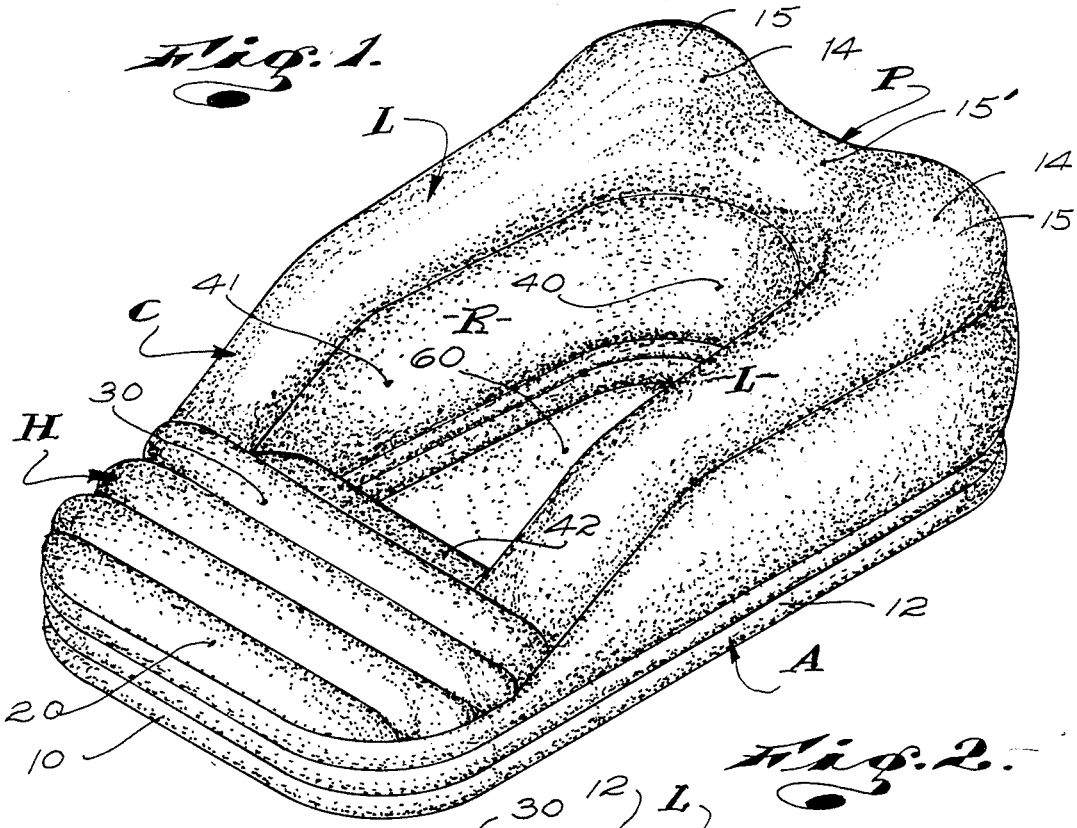
FIG. 1 is an isommetric view of an inflatable body support embodying my invention.
Figure 2:
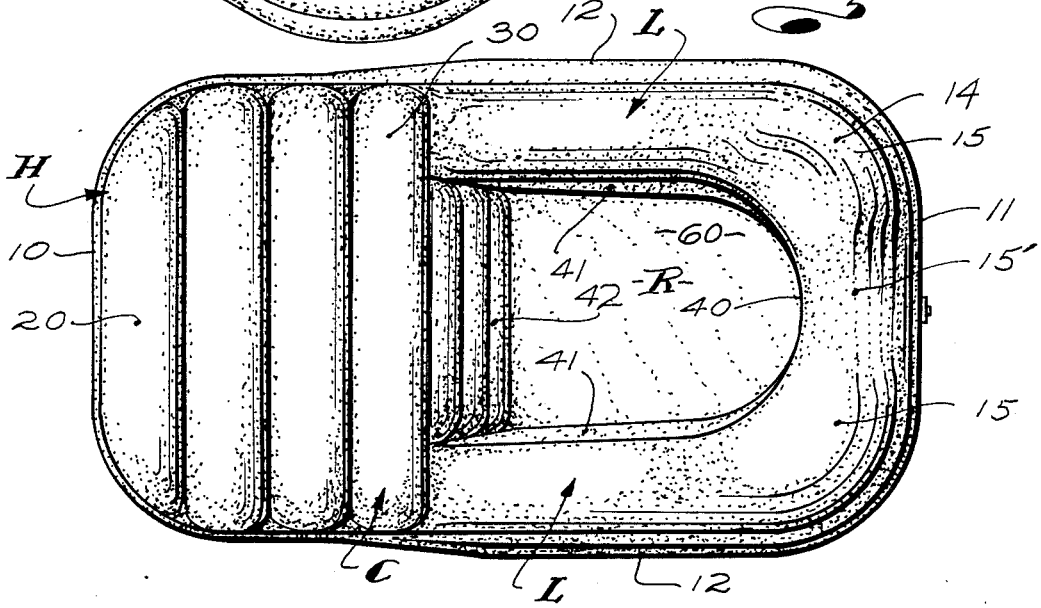
FIG. 2 is a top view of the support shown in FIG. 1.
Figure 3:
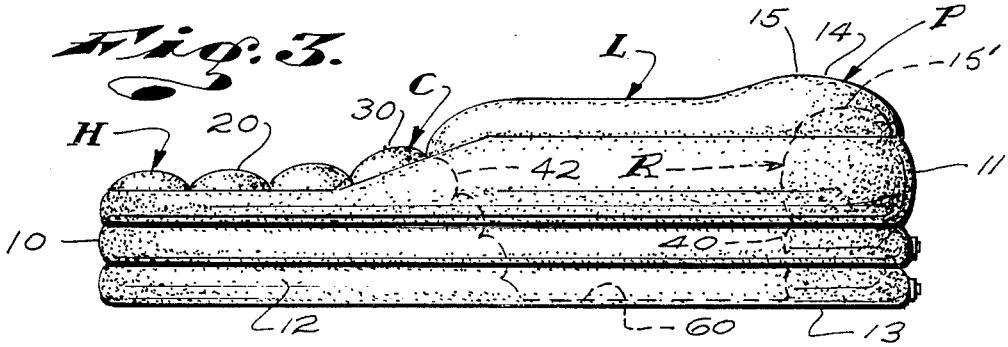
FIG. 3 is a side view of the support.
Figure 4:
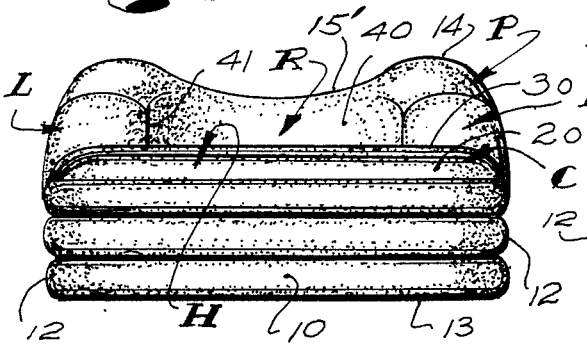
FIG. 4 is a front view of the support.
Figure 5:
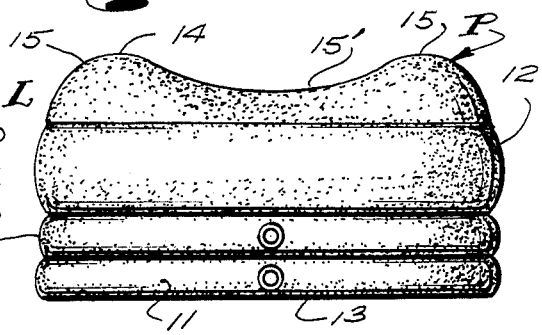
FIG. 5 is a rear view of the support.

In FIGS. 1 through 5 of the accompanying drawings, I have illustrated an inflatable body support A embodying my invention. In FIGS. 6 through 9 of the drawings, I have illustrated a form or embodiment of my invention that is made and/or fabricated of foam plastic.

In practice, an inflatable form of the invention, such as is shown in FIG. 1 through 5 of the drawings, is provided for distribution and sale of the invention in and through those normal channels of trade where shelf space is at a premium and for use by pregnant women who travel or frequently move from one location to another. The inflatable structure is such that when it is deflated it can be folded and compacted into a small package that occupies little shelf space and/or a packaged that can be easily and conveniently transported or shipped from one place to another.

The foam plastic embodiment of my invention shown in FIGS. 6 through 9 of the drawings can be advantageously made of a suitable soft resilient and compressible foam plastic material. While the foam plastic material can be a closed or non-interconnected cellular plastic, it is preferred that a suitable reticulated or interconnected cellular foam material that readily breathes (air) and through which fluids might readily drain be used.

The latter, foam plastic, form of my invention is that form of the invention physicians and health care professionals have expressed a preference for and that best meet the health and safety criteria that are most often followed in professional health care facilities.

The inflatable structure illustrated comprises an exterior casing that is fabricated of cut and thermally welded together parts of thin, flexible and supple sheet plastic in accordance with common sheet plastic fabricating practices. The casing can be provided with panels, partitions, compartments and seams that work to maintain the structure in suitable and intended form or shape when inflated. The placement, shape and extent of those panels, partitions, compartments and the like required in a water-filled casing structures are notably different than that which is required in an air-filled structure. Further, in either a water-filled or an air-filled structure embodying my invention, the number of pieces material and the placement and the positioning of the seams and the like can very widely without adversely affecting the invention. Accordingly, I have elected not to illustrate and describe the structure illustrated in FIG. 1 through 5 of the drawings in a piecemeal and detailed manner.

It is readily apparent that anyone skilled in the art of fabricating sheet plastic inflatable structures and the like would only be required to exercise ordinary skill to construct an inflatable body support embodying the invention.

The foam plastic form of my new support structure shown in FIG. 6 through 9 of the drawings is easily made by fixing together two or more pieces of foam plastic material that has been suitable cut and sculpted in accordance with old and long-practiced foam plastic fabricating techniques.

The foam plastic embodiment of my invention can be covered with a jacket or cover (not shown) of suitable soft and comfortable fabric, such as terry cloth. Such a cover or jacket slight compresses and rounds the several edges and corners of the support structure and imparts it with a soft, gentle and pleasing appearance that is highly desirable. It has been determined that such a cover is unnecessary and undesirable when the support structure is to be used in health care institutions, such as hospitals, while it is quite necessary for effective merchandising in ordinary channels of trade.

In practice, if the support structure A is made in the form of a "bean-bag," a fabric skin or casing, not notably unlike the sheet plastic structure of the inflatable form of the invention is provided and the casing is filled with a fluid mass of particulate material, such as shredded, soft foam plastic or styrofoam beads.

However made, the support structure A that I provide is from 3½ feet to 4 feet long, from 2 feet to 2½ feet wide, and about 1 foot in maximum vertical extent. The support is substantially rectangular in plan configuration, with certain of its corners rounded for asthetic purposes.

The support A has a substantially flat, vertical, forwardly disposed head end 10, a substantially flat, vertical, rearwardly disposed rear end 11, substantially flat, vertical, laterally outwardly disposed, laterally spaced sides 12, a flat horizontally downwardly disposed floor engaging bottom 13 and an upwardly disposed top. When appropriate, the whole of the support A is a unitary part and can and will be described as comprising a body.

The rear end portion of the support A, forward of the rear end 11 thereof defines a high or elevated pelvis supporting portion P that is about 12 inches in vertical extent, extends longitudinally forward from the rear end 11; and that extends laterally from one side of the support to the other. In practice, the portion P can be from 6 inches to 8 inches in longitudinal extent. The support portion P has an upwardly disposed pelvis support surface 14, laterally spaced opposite side portions 15 that are engaged by the crests of the ilium of a user's pelvis when the user is supported, face down, over or atop the support. The top of portion P is formed so that its surface 14 has a central a portion 15' between the side portions 15 and that opposes and supports the central pubis of the user's pelvis. Since the pubis is spaced forward of the ilium, I prefer that the central portion 15' of the top surface 14 be slightly lower than the outer or opposite side portion 15 thereof so that the major supporting forces applied by the support onto the user's pelvis are directed onto the ilium and so that such forces are not concentrated onto the pubis. The noted vertical displacement of the portions 15 and 15' of the surface 14 are not entirely necessary, particularly when the support is sufficiently soft and resilient to substantially freely conform to the shape of the user's body. It does, however, become necessary if the support is made rather stiff or hard and such that special effort to distribute forces uniformly is dictated.

When the support A is in use and the user's pelvic region is held up by the portion P, the user's hip joints, at the juncture of the user's femur bones and her pelvis occur above the rear edge portions of the surface 14 and the user's femur bones and thighs extend downwardly and rearwardly from the support A to that point where the user's knees engage and rest upon the floor upon which the support rests.

The head or front end portion of the support A rearward of the front end 10 thereof defines a lower head support portion H. The portion H is about 5 inches in vertical extent, about 12 inches in longitudinal extent and extends laterally from one side of the support to the other. The portion H has a flat, horizontal upwardly disposed head support surface 20 upon which the head of the user is supported.

In practice, the user's head can be turned sideways or is tipped slightly upwardly so that her mandible E or lower jaw engages and is supported by the support and so that the support does not interfere with her breathing. (Such positioning of one's head is instinctive in such situations.)

Extending rearward from the head portion H of the support is a chest support portion C. The portion C extends laterally from one side to the other of the support and is from 8 to 10 inches in longitudinal extent. The portion C has an upwardly and forwardly disposed or upwardly and rearwardly inclined chest support surface 30. A lower forward edge of the surface 30 joins a rear edge of the surface 20 of the portion H (which is about 5 inches high). The surface 30 has upper rear edge that is from between 8 and 11 inches high.

In normal and intended use of the support A, the user's clavicle or collarbone engages and is supported across the forward portion of the surface 30 and is therefore supported a short distance (from 2 to 3 inches) above or higher than the chin of the user which is supported atop the portion H. Accordingly, the user's head is let to rest lower than her collarbone and her neck is thereby let to relax and to extend somewhat forwardly and downwardly. That is, the user's head is not urged and held up in such a manner as to cause the user's collarbone to be held or urged upwardly or to cause the user's neck to be forcably bent upwardly and forwardly relative to the support.

The upper end portion of the user's sternum or breastbone extends up and longitudinally of the upper central portion of the surface 30 and the user's shoulder structure comprising the shoulder joints defined by the user's scalpuli and the humerus bones engage and are supported by the upper lateral outside portions of the surface 30.

When a user is engaged and rests upon the top of the support A, her arms are let to extend laterally outwardly, downwardly and either rearwardly or forwardly (relative to the longitudinal axis of the support) and to engage and rest atop the floor in a most comfortable and relaxed manner.

The support structure A next includes an upwardly opening abdomen receiving cavity or recess R positioned substantially centrally of the support A between the rear pelvis support portion P and the chest support portion C and that is spaced inward from the outer sides 12 of the structure. The recess R can be from 8 inches to 10 inches deep, from 17 inches to 19 inches in longitudinal extend and from 12 inches to 15 inches in lateral extent. In the case illustrated, the recess has a vertical rear wall that is rounded curved or with a radius of approximately 6 inches. The opposite inside walls or surfaces 41 of the recess are substantially vertical and are shown diverging forwardly as they continue forwardly from the rear surface 40 to where they join with a front surface 42 of the recess. The front surface 42 of the recess is disposed upwardly and forwardly and is inclined upwardly and forwardly at an angle of close to 40 degrees. The surface 42 is a breast supporting surface, that is, it occurs beneath that portion of the user's rib cage at which (in most instances) the user's breasts occur. When lying prone atop the support, a user's breasts depend into the recess R to engage the surface 42. The surface 42 is such that the user's breasts are not let to depend freely into the recess in a discomforting manner and is at an appropriate angle so that it receives and supports the major portion of the weight of the user's breasts without, in effect, holding and urging the breasts upwardly in a potentially discomforting manner.

In the preferred form and carrying out of my invention, the forward end portion of the recess R extends a short distance into the rear portion of the chest support portion C, laterally inward of those portions of the portion C where the user's shoulders tend to occur and which are slightly above that portion of the user's rib cage where the upper portion of the user's breasts are likely to occur. Thus, excessive pressing of the breasts between the user's chest and the support is not likely to occur.

Still further, in the preferred form and carrying out of the invention the rounded rear end portion of the recess R extends a short distance into the forward portion of the rear pelvic supporting portion P of the structure A, into close proximity to the pubis engaging portion of the support and so that the lower portion of the user's abdomen immediately above the pubis is free to enter and depend into the recess R.

The intermediate side portions of the support A, between the portions P and C thereof and at the opposite sides of the recess R, define laterally spaced longitudinally extending abdomen support portions L with top lateral-anterior abdomen support surfaces 50 that engage and afford yielding lateral inward and upward support to the lateral-anterior portions of the user's abdomen. That is, the portions 50 engage and support those side portions of the user's abdomen that occur laterally outward of the central portion of the abdomen in which the fetus occurs.

The lateral support portions L serve to support and hold the sides of the user's abdomen up and prevent sagging and forward (downwardly) bending of the wearer's back toward and into the recess R.

It is to be noted that the portion of the user's abdomen that extends between the portions P and C of the support A bridge and extend over the recess R and, if unsupported, as by the portions L, might tend to sag downwardly into the recess R, adversely bending and stressing the user's back in a manner that exacerbates that stressing of the user's back normally caused by pregnancy and that is the cause of much pain and discomfort.

In the support structure A that I provide, the lateral extent of the recess R is made slightly less than the anticipated lateral extent of the pregnant user's abdomen during the later stages of pregnancy and such that the lateral support portions L are displaced both laterally and downwardly by the user's abdomen in such a manner that the portions L afford sufficient lateral and vertical inward support to prevent the users from dropping into the recess and causing her back to sag and become adversely stressed.

It is important to note that the distance between the portions P and C across which the user's body must bridge is not so great that great supporting force must be afforded by the portions L to prevent adverse sagging of the user's body. This is because the user's body is supported in a forwardly arched condition and will not readily sag and move to a rearwardly arched condition if nominal supplemental vertical support, as provided by the portions L, is provided.

The bottom of the recess R is closed by a bottom wall 60 that serves to tie the lower portions of the opposite side portions L together and to thereby prevent lateral outward displacement of the lower portions of the side portions L.

Due to the flexibility and resiliency built into the structure A, though the lower portions of the portions L are tied together by the bottom wall 60 the upper portions of the portions L can be readily yieldingly compressed and displaced laterally outward by the user's abdomen as it is moved downwardly into the confines of the recess R. As result of the foregoing, the structure A is substantially self-adjusting to accommodate different sizes of abdomens or to accommodate a user's abdomen as her fetus grows.

In the form of my invention shown in FIGS. 6 through 9 of the drawings, the several parts and/or portions of the structure A described above are shown as being rather sharply angularly related in what might be said to be an exaggerated manner.

Figure 6:
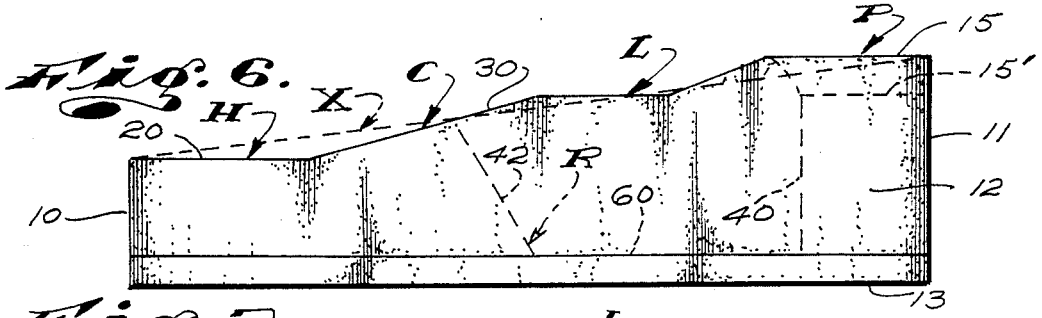
FIG. 6 is a top view of a body support embodying my invention that is fabricated of foam plastic.
Figure 7:
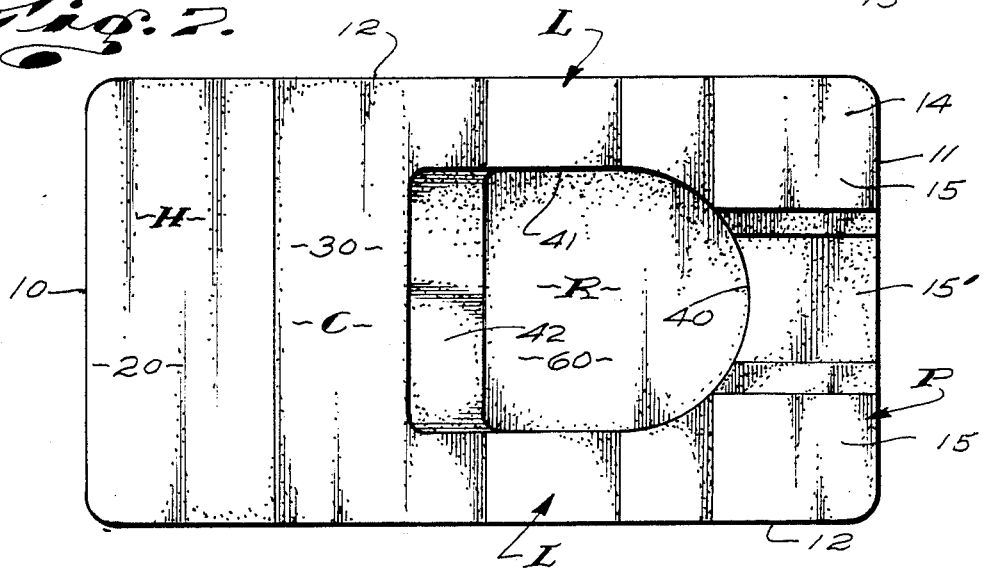
FIG. 7 is a top view of the structure shown in FIG. 6.
Figure 8:
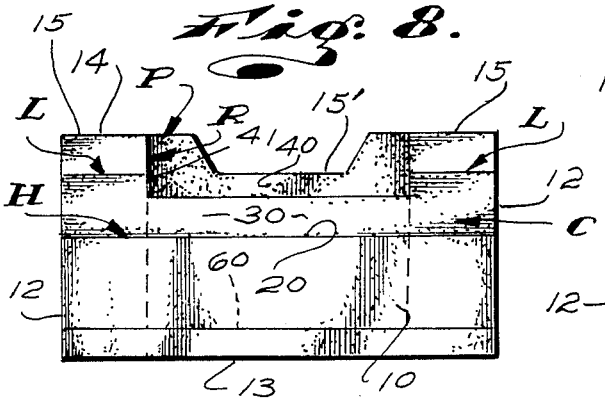
FIG. 8 is a front view of the support structure shown in FIG. 6.
Figure 9:
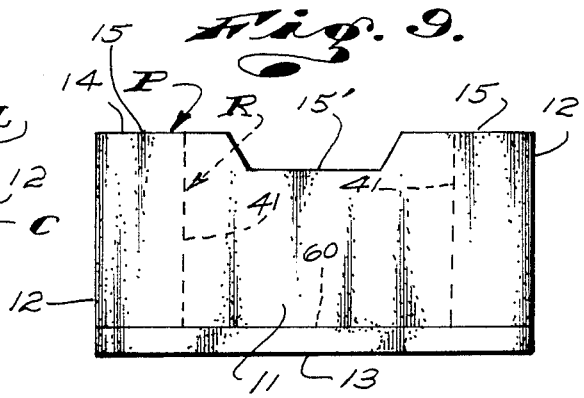
FIG. 9 is a rear view of the support structure shown in FIG. 6.

In FIG. 6 of the drawings, in dotted lines, I have shown a modified form of the invention in which the top surfaces of the several portions of the structure occur or lie on a single upwardly and rearwardly inclined plane. In such a modified embodiment of the invention, the same portions H, C, L and P are present though they are less clearly defined one from the other. The function of the foregoing modified structure would not be materially altered or affected since those functional changes that might occur are well within the functional latitude or limits afforded by the compressibility and resiliency that is or can be built into the structure.

Figure 10:
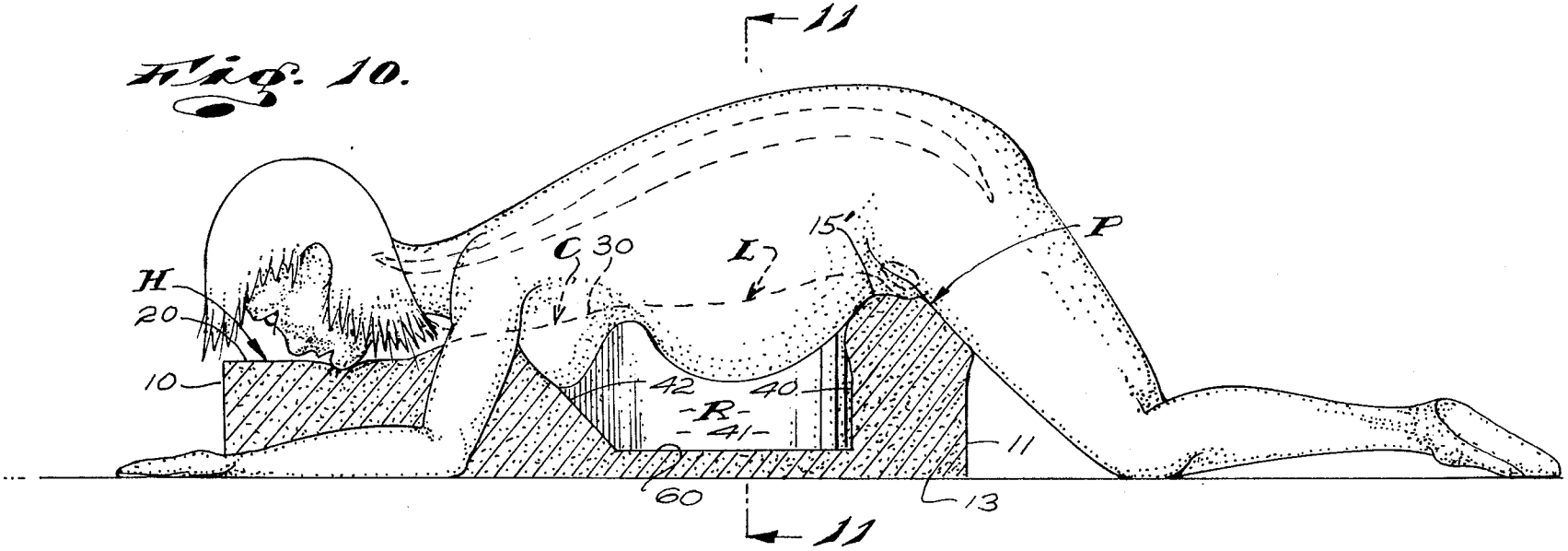
FIG. 10 is a diagrammatic side view of my body support showing it in use; and, FIG. 11 is a view taken substantially as indicated by line 11—11 on FIG. 10.
Figure 11:
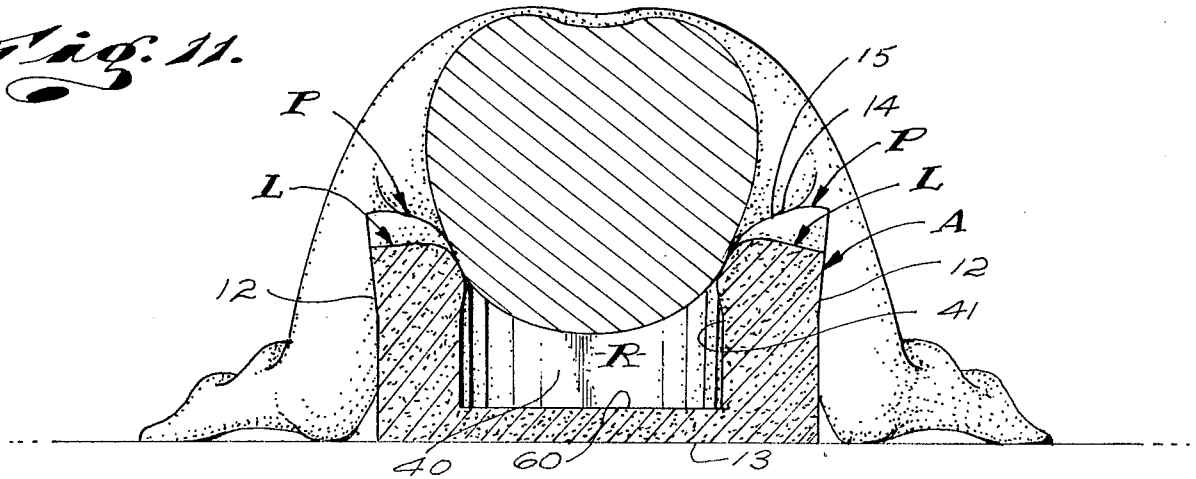

In FIG. 10 of the drawings, I have diagrammatically illustrated a user supported atop the support A. It will be noted that the pelvic region of the user is supported by the portion P of the structure A in an elevated condition and that her legs extend downwardly and rearwardly therefrom in a manner that tends to rock and turn the lower portion of her pelvis downwardly and the upper portion of her pelvis upwardly. The shoulder and chest portions of the user, supported by the upwardly and rearwardly inclined portion C of the structure, are supported on a plane that is lower than the plane on which the users pelvic region is supported. The upper portion of the user's spine related to her chest is therefore inclined upwardly and rearwardly.

The user's head, supported by the portion H of the structure A, is slightly lower than her shoulders and chest and such that it tends to keep the upper (forward) portion of her chest down and the lower (rear) portion thereof up.

The portion of the user's abdomen in which the fetus is carried and that extends between the chest and pelvic portions of the user's body is supported at its opposite sides by the portions L of the structure A with the central fetus distended portion thereof depending substantially freely into the recess R. The lower (rear) portion of the user's abdomen nearest to the pelvic portion of the user's body is disposed slightly rearwardly and downwardly while the upper (forward) portion of her nearest to her chest portion is disposed forwardly and downwardly. As a result of the above, the lower lumbar region of the user's spine that is, her lower back is slightly arched in a most comfortable and restful manner.

In practice, the size, weight and the distribution of the weight of the person using the support structure A affects the positioning and/or dispositioning of the several parts of the user's body, but with rare exception, the basic relationship of body parts to the support A noted above is attained.

When the structure is in use, the portion of the user's spine related to her abdomen is substantially relieved of compressive forces and is often tensioned to a desirable degree. This is due to the fact that the user's legs effectively anchor the pelvic portion of her body in place while the lower downwardly and forwardly inclined head, shoulders and chest portions of her body tend to move forwardly and downwardly, relieving compressive forces and directing tensile forces onto and through her spine.

Having described only typical preferred forms and embodiments of my invention, I do not wish to be limited to the specific details herein set forth but wish to reserve to myself any modifications and/or variations that might appear to those skilled in the art and that fall within the scope of the following claims.

Having described my invention, I claim:

1. A prenatal body support adapted to support a pregnant female in a prone position with her lower back arched upwardly, with the head and knees supported in a lowered position relative to her lower back, said support comprising an elongate, soft, resilient load supporting body with longitudinally spaced front and rear ends, laterally spaced outer sides, a flat downwardly disposed bottom and an upwardly disposed top surface, the top surface having an upper rear pelvic support portion extending longitudinally and transverse the rear end portion of the body, a forward head support portion extending longitudinally and transversely of the front end portion of the body on a plane spaced below the plane of said pelvic support portion, a pair of laterally spaced longitudinally extending lateral-anterior abdominal support portions extending forward from said pelvic support portion, a longitudinally and transversely extending chest support portion between said head support portion and said abdominal support portions, and an upwardly opening abdomen receiving recess, the open top of said recess being defined by said pelvic, chest and abdomen support portions.

2. The prenatal body support set forth in claim 1 wherein said abdominal support portions of said top surface are on a plane spaced above said plane of the head support portion thereof and wherein said chest support portion of said top surface is inclined upwardly and rearwardly.

3. The prenatal body support set forth in claim 1 wherein said pelvic support portion of said top surface has laterally spaced ilium support portions on the plane of said pubic support and has a central pubic support portion between and on a plane spaced below said ilium support portions.

4. The prenatal body support set forth in claim 1 wherein said abdominal support portions are on a plane spaced above the plane of said head support portion and wherein said chest support portion extends upwardly and rearwardly from said head support portion to said abdominal support portions, said pelvic support portion has a pair of laterally spaced ilium support portions and has a central pubic support portion that is between and occurs on a plane that is spaced below the plane on which the ilium support portions occur.

5. The prenatal body support set forth in claim 1 wherein said body of the support includes an inflatable exterior casing fabricated of thin flexible and supple sheet plastic material and a volume of water within and substantially filling said casing.

6. The prenatal body support set forth in claim 1 wherein said body of the support includes an inflatable exterior casing fabricated of thin flexible and supple sheet plastic material and a volume of air within and filling said casing.

7. The prenatal body support set forth in claim 1 wherein said body of the support is made of soft compressible and resilient foam plastic.

8. The prenatal body support set forth in claim 1 wherein said body of the support includes an exterior casing fabricated of soft flexible sheet material and a fluid filler of particulate material within and filling said casing.

9. A prenatal body support adapted to support a pregnant female in a prone position with her lower back arched upwardly, with the head and knees supported in a lowered position relative to her lower back, said support comprising an elongate, soft, resilient load supporting body with longitudinally spaced front and rear ends, laterally spaced opposite sides, a flat horizontal downwardly disposed bottom and a substantially upwardly disposed body supporting top surface, said body being formed to define a rear pelvic support portion that extends longitudinally and laterally of the rear end portion of the body, a front head support portion that extends longitudinally and laterally of the front end portion of the body, a pair of laterally spaced lateral-anterior abdominal support portions that extend longitudinally forward from said pelvic support portion, a chest support portion that extends laterally and longitudinally between said head and abdomen support portions, and an upwardly opening abdomen receiving recess between and defined by said chest, pelvic and abdomen support portions, the pelvic, abdomen, chest and head support portions defining upwardly disposed pelvis, abdomen, chest and head engaging and supporting portions of said top surface, the pelvic supporting portion of the top surface occuring on a horizontal plane spaced above the horizontal plane on which the head supporting portion of the top surface occurs.

10. The prenatal body support set forth in claim 9 wherein said body includes an inflatable exterior casing fabricated of soft, flexible and supple sheet plastic and a fluid medium within and supporting the casing.

11. The prenatal body support set forth in claim 9 wherein the body includes an exterior casing fabricated of soft flexible sheet material and a fluid filler of particulate material within and supporting the casing.

12. The prenatal body support set forth in claim 9 wherein said recess is defined by substantially vertical rear and side walls and by a transversely extending and downwardly and rearwardly inclined front breast support surface.

13. The prenatal body support set forth in claim 9 said recess is defined by substantially vertical rear and side walls and by a transversely extending and downwardly and rearwardly inclined breast support surface, said breast support surface extending upwardly and forwardly from between the lower forward portions of said abdominal support portions into an upper rear portion of said chest support of the body.

14. The prenatal body support set forth in claim 13 wherein said body includes an inflatable exterior casing fabricated of thin, flexible and supple sheet plastic material and a volume of water within and supporting the casing.

15. The prenatal body support set forth in claim 13 wherein said body includes an exterior casing fabricated of thin, flexible and supple sheet plastic material and a filler of fluid within and filling said casing.

* * * * *